US010401033B2

(12) United States Patent
Olivos Perez et al.

(10) Patent No.: US 10,401,033 B2
(45) Date of Patent: Sep. 3, 2019

(54) GAS STOVE OVEN BURNER, AND METHOD FOR ITS MANUFACTURE

(71) Applicant: CTI S.A., Santiago (CL)

(72) Inventors: Ambrosio Olivos Perez, Santiago (CL); Héctor Galvez Bastias, Santiago (CL); Luís Strube Vega, Santiago (CL)

(73) Assignee: CTI S.A., Santiago (CL)

( * ) Notice: Subject to any disclaimer, the term of this patent is extended or adjusted under 35 U.S.C. 154(b) by 500 days.

(21) Appl. No.: 14/784,318

(22) PCT Filed: Apr. 15, 2014

(86) PCT No.: PCT/IB2014/060744
§ 371 (c)(1),
(2) Date: Oct. 14, 2015

(87) PCT Pub. No.: WO2014/170830
PCT Pub. Date: Oct. 23, 2014

(65) Prior Publication Data

US 2016/0040891 A1 Feb. 11, 2016

(30) Foreign Application Priority Data

Apr. 16, 2013 (CL) ..... 1049-2013

(51) Int. Cl.
*F24C 3/00* (2006.01)
*F24C 3/08* (2006.01)
(Continued)

(52) U.S. Cl.
CPC ..... *F24C 3/085* (2013.01); *F23D 14/06* (2013.01); *F23D 14/10* (2013.01); *F23D 14/70* (2013.01); *F23D 2213/00* (2013.01)

(58) Field of Classification Search
CPC ..... F24C 3/085; F23D 14/06; F23D 14/70; F15D 1/0015; F15D 1/00; F15D 1/02;
(Continued)

(56) References Cited

U.S. PATENT DOCUMENTS 1,818,471 A 8/1931 Geauque
2,566,318 A * 9/1951 David ..... B23K 11/0046 165/181
(Continued)

FOREIGN PATENT DOCUMENTS

GB 1324775 A * 7/1973 ..... B21D 51/16
GB 1499213 1/1976
(Continued)

OTHER PUBLICATIONS

International Search Report for international Application No. PCT/IB2014/060744 dated Jul. 30, 2014.
(Continued)

*Primary Examiner* — Jason Lau
(74) *Attorney, Agent, or Firm* — RatnerPrestia

(57) ABSTRACT

A gas stove oven burner having a venturi, and formed by a casing manufactured by forming at least one metal plate, and comprising at least one flange inside the burner located downstream from the venturi, and inclined from an internal flow of fluid. A method for manufacturing a burner is also provided

9 Claims, 5 Drawing Sheets

(51) Int. Cl.
*F23D 14/10* (2006.01)
*F23D 14/70* (2006.01)
*F23D 14/06* (2006.01)

(58) Field of Classification Search
CPC ..... F23C 2900/99005; F23C 99/001; B01D 21/0087; B01D 21/265; B01D 45/04; B01D 45/12; B01D 2239/086; B01D 2239/10; B01D 2239/1208
See application file for complete search history.

(56) References Cited

U.S. PATENT DOCUMENTS

| | | | | |
|---|---|---|---|---|
| 3,185,204 | A | 5/1965 | Loeb | |
| 4,872,833 | A * | 10/1989 | Kramer | B01F 5/0415 431/346 |
| 4,927,355 | A | 5/1990 | Haire | |
| 5,163,830 | A * | 11/1992 | Pfefferkorn | B01F 5/0413 366/163.2 |
| 5,340,305 | A | 8/1994 | Joyce | |
| 6,979,192 | B2 | 12/2005 | Ikuta et al. | |
| 2004/0115580 | A1 | 6/2004 | Ikuta | |
| 2011/0048400 | A1* | 3/2011 | Biagioli | F23D 14/06 126/39 E |

FOREIGN PATENT DOCUMENTS

| | | | |
|---|---|---|---|
| GB | 1499213 | | 1/1978 |
| JP | 07280219 | | 10/1995 |
| JP | H07280219 | | 10/1995 |
| JP | 2004190940 | A | 7/2004 |
| RU | 2323386 | C1 * | 4/2008 |
| TR | 201107593 | | 1/2012 |
| WO | 2013019165 | | 2/2013 |

OTHER PUBLICATIONS

European Examination Report for European Application No, 2014255335, dated Aug. 14, 2017, 3 pages.
European Communication for European Application No. 14 729 043.1, dated Jul. 20, 2017, 4 pages.
Chilean Office Action with English language translation for Application No. 2013-001049 dated Apr. 13, 2016, 15 pages.
Australian Examination Report for Australian Application No. 2014255335, dated Aug. 14, 2017, 3 pages.
Spanish Examination Report for Spanish Application No. 2013-001049, dated Apr. 16, 2013, including partial English translation, 14 pages.

* cited by examiner

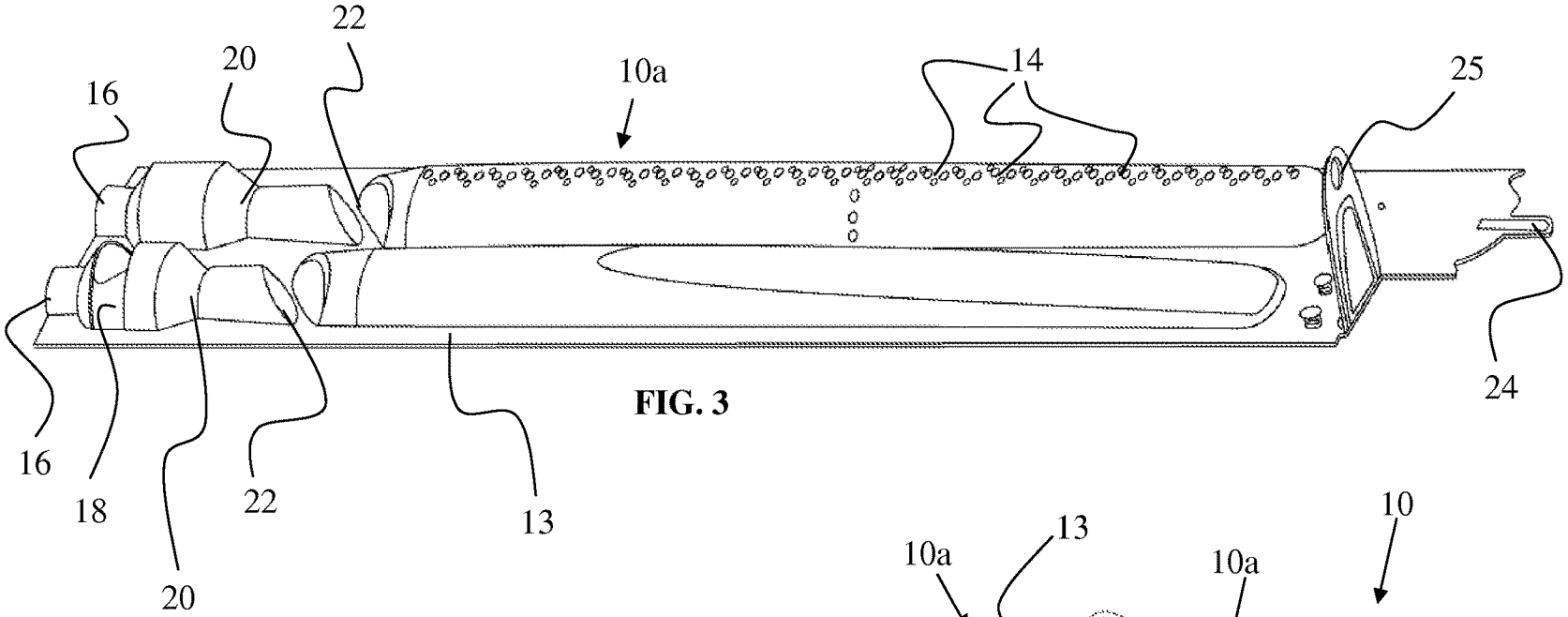
FIG. 3
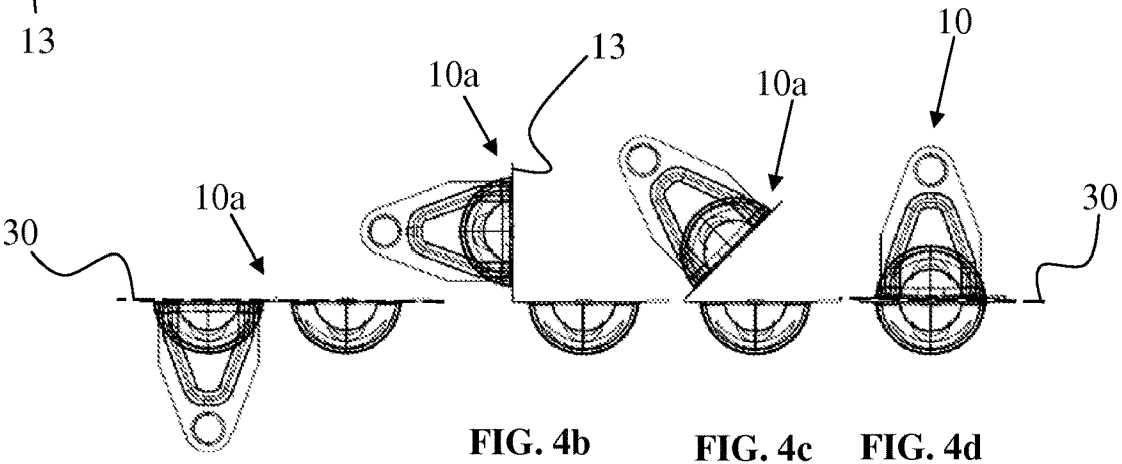
FIG. 4d
FIG. 4c
FIG. 4b
FIG. 4a

GAS STOVE OVEN BURNER, AND METHOD FOR ITS MANUFACTURE

This application is a U.S. National Phase application of PCT International Application No. PCT/IB2014/060744, filed Apr. 15, 2014, which claims the benefit of CL 1049-2013, filed Apr. 16, 2013, both of which are incorporated by reference herein.

TECHNICAL FIELD

The present invention refers to devices that mix fuel gas and air for combustion. More particularly, the present invention refers to burners for gas stove (kitchen) ovens equipped with devices that mix fuel and air.

BACKGROUND OF THE INVENTION

The state of the art regarding gas stoves comprises a large number of varieties of forms and configurations for oven burners, each one of them providing a particular advantage for a better food cooking or combustion optimization.

Some gas stoves use air regulators in order to optimize the amount of air mixed with fuel gas in the burner inlet. This kind of device is widely used in ovens working on both natural gas and liquefied gas, since the optimal ratio of air in the mixture for combustion varies based on the fuel used. However, regulators represent an additional, more expensive element making the injection system and the fuel burn-up more complex.

Gas stoves that comprise devices for optimizing the combustion process in the oven burners by optimizing gas and air rates in venturi and along the burner, or by providing a device to improve the mixture between them, are also known. Some of such stoves, for example, adopt a metal mesh in the burner venturi outlet in order to generate a turbulent flow, therefore promoting a better, faster air/fuel gas mixture. Additionally, this mesh promotes a pressure drop of the flow, helping ensure that there will be no flame leaking from the burner.

In addition, the use of internal mechanisms for the burner in order to provide mainly a rotation movement in the flow is known, therefore improving the fuel gas/air mixture. Different mechanisms of this kind are found, for example, in documents U.S. Pat. Nos. 4,872,833, 1,818,471, and GB1499213.

However, all the aforementioned techniques have the inconvenient of using at least one additional component to provide the effect of improving the fuel gas/air mixture, thus making the manufacture of burners more expensive and slow. Additionally, at least one additional component is implied in its maintenance when necessary, implying more costs.

Therefore, there is the need for a gas stove oven burner that surpasses these inconveniencies in a simple, efficient way.

PURPOSES OF THE INVENTION

A first purpose of the present invention is to provide a gas stove oven burner, and a method for its manufacture, able to promote a total mixture of fuel gas and air, thus allowing the use of both natural gas and liquefied gas.

A second purpose of the present invention is to provide a gas stove oven burner, and a method for its manufacture, to promote at the same time an efficient air/fuel gas mixture with a pressure drop, with no need for an additional internal component for the burner.

These purposes and other advantages of the invention will be more evident from the following description and the enclosed drawings.

BRIEF DESCRIPTION OF THE INVENTION

In order to attain the aforementioned purposes, the present invention provides a gas stove oven burner comprising a venturi, and formed by a casing manufactured by forming at least one metal plate, and comprising at least one internal flange to the burner located downstream from the venturi, and inclined from an internal flow of fluid, making any internal element additional to the burner to promote a better gas/air mixture unnecessary.

The present invention also provides a method for manufacturing a gas stove oven burner comprising the stages of (i) forming a metal plate in order to provide two side-to-side halves for a burner casing, (ii) folding the casing halves for them to be facing each other, thus forming the burner itself, and (iii) fastening the free ends of the casing, wherein at least one flange inside the burner located downstream and inclined from an internal flow of fluid, is additionally provided in the stage of forming a metal plate.

DESCRIPTION OF FIGURES

The following detailed description refers to the figures below, of which:

FIG. 3 illustrates a pressed metal plate that will generate a burner of the present invention;

FIGS. 4*a* and 4*d* illustrate schematic front views of the metal plate from FIG. 3 being folded in order to form the burner of the present invention;

DETAILED DESCRIPTION OF THE INVENTION

The following description starts with a possible embodiment of the invention. As it will be evident to those skilled in the art, however, the invention is not limited by this particular embodiment.

Figure 1:
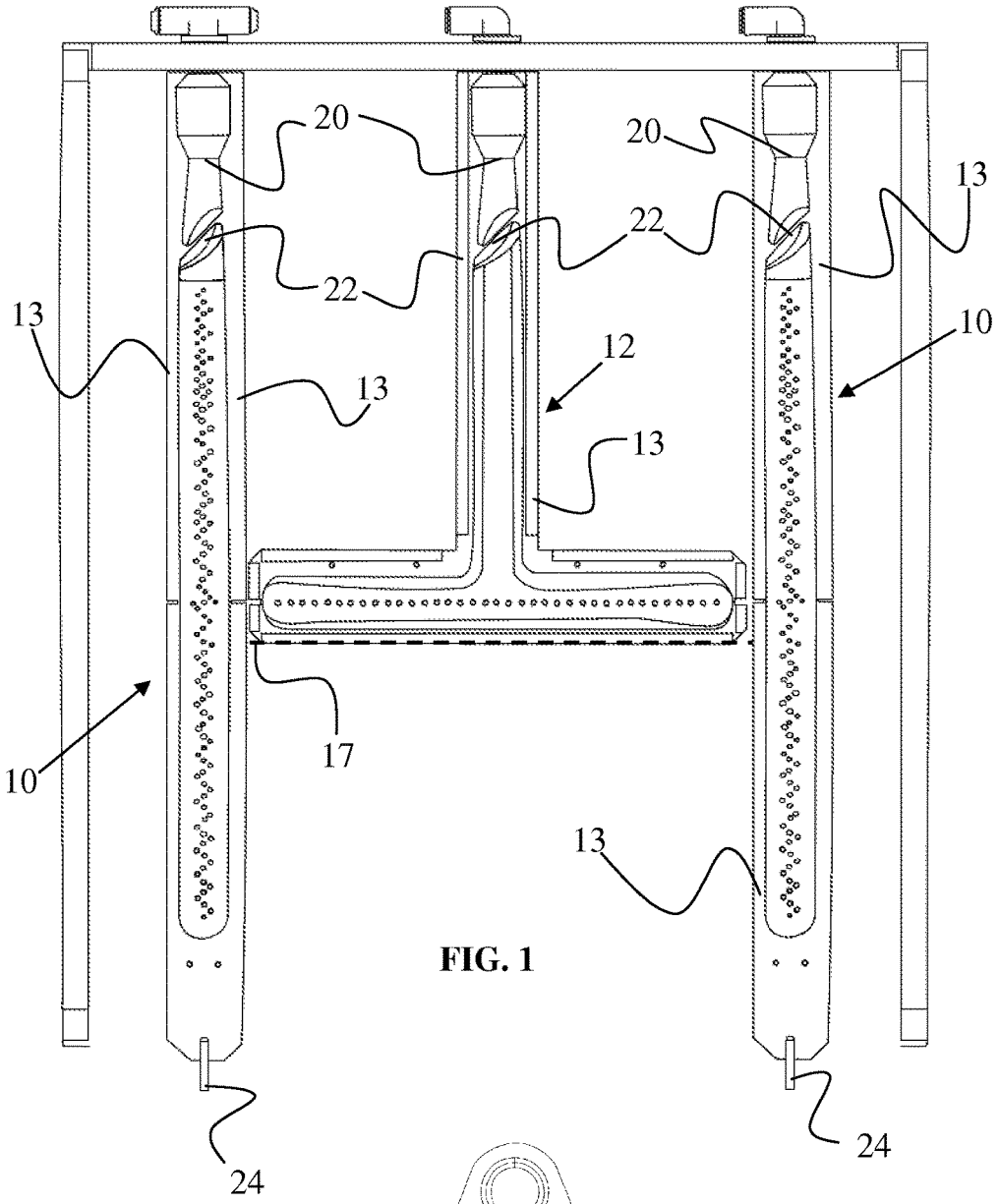
FIG. 1 illustrates a set of burners from a gas stove oven according to the present invention.
Figure 2:
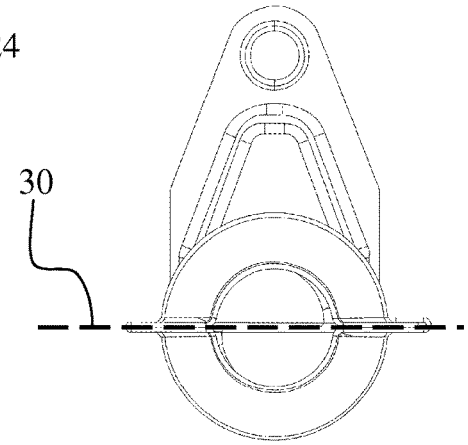
FIG. 2 illustrates a front view from a lateral burner of the present invention.

FIG. 1 illustrates a set of burners in a gas stove oven. As in the illustration, the oven comprises two lateral burners 10, and a pilot burner 12. In this type of burner configuration in gas stove ovens, the substantially rectilinear arrangement of lateral burners 10, and a pilot burner 12 in form of a T between them, is not uncommon. Thus, when the pilot burner 12 is manually or automatically lit, its flame propagates to the lateral burners 10.

In the configuration shown in FIG. 1, the pilot burner 12, normally positioned near the oven door, is displaced to the center of the oven in order to reduce the temperature of the door region, thus preventing the excess of heat release to the outside environment.

Each of the lateral 10 and pilot burners 12 comprise preferably a metal casing. Each burner's casing 10, 12, as it is illustrated in FIG. 3, preferably comes from only one pressed metal sheet 10*a*, and is also preferably cut in only one step in order to form its two halves (only one of the lateral burners 10 is illustrated).

FIG. 4*a* illustrates a schematic front view of the pressed plate in FIG. 3. Once formed and cut, the sheet with the two halves of the casing 10*a* is folded around its longitudinal axis in order to form the lateral burner 10. This process is illustrated in FIGS. 4*a* to 4*d*. Preferably, lateral portions 13 of the metal plate exceed the burner region, thus defining a central plane 30 of itself (the same plane from the non-folded metal plate.)

In the case of the pilot burner 12, a plate can be formed and cut in the appropriate format, and folded in the same way, the folding being preferably produced around the axis 17 defined by the upper part in form of a T, that is, the axis located in the most frontal part of the pilot burner 12.

Figure 5:
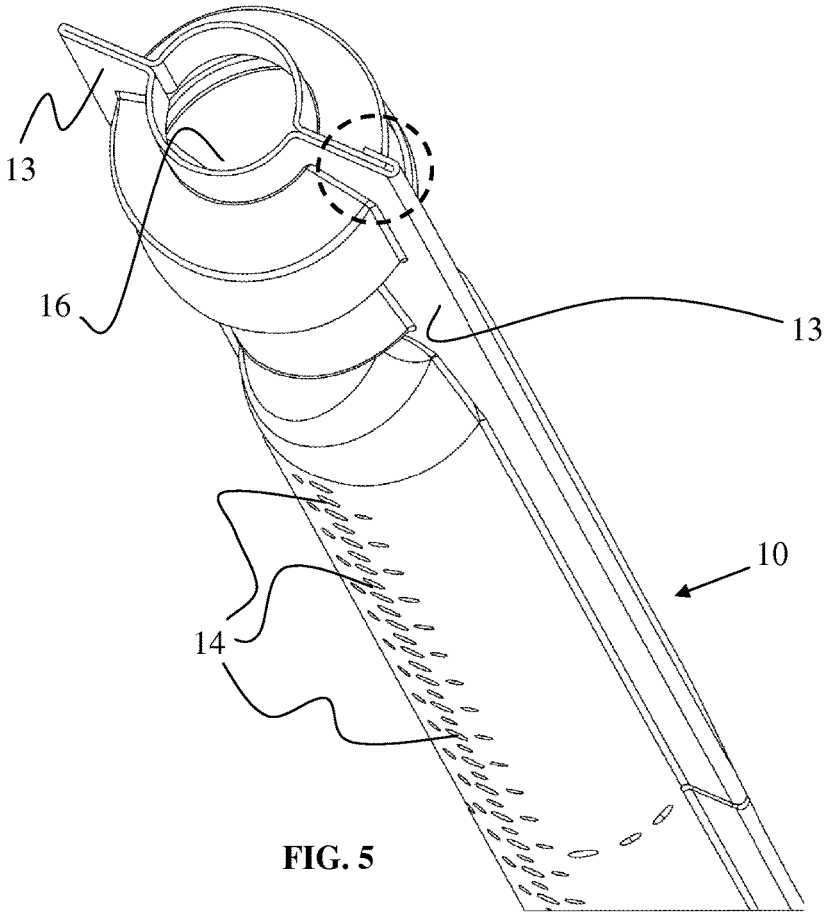
FIG. 5 illustrates a perspective view of the front part from the burner of the present invention.

Preferably, the two halves of the burners 10, 12 are joined together by any means of fastening, preferably by means of at least one of: riveting, welding, folding one end over the other, plying, among others. FIG. 5 illustrates in detail a preferred configuration for the burner, in which the folding of one end over the other in order to fasten the two halves of the burners 10 is used.

The casings define an interior space in the form of ducts in the burners 10, 12, wherein the fluid for combustion passes through. Additionally, the burners 10, 12 comprise a plurality of holes 14 through which the fuel gas/air mixture exits and is burned.

The burners 10, 12 comprise in their anterior portions an inlet 16 connected to a fuel gas or liquefied natural gas source, as in a residential supply network or a gas cylinder. Gas is injected in the inlet 16 at a certain rate. Near the gas inlet, at least one air inlet 18 (FIG. 6), and one tube section of very low diameter, already known in the art as venturi 20, are provided. Preferably, only one air inlet 18, located at the lower part of such burner 10, 12, is provided. This ensures a higher richness of $O_2$ in the air entering the burner 10, 12 since the tendency of the air already combusted, being hotter and rich in $CO_2$, is to go up and stay in the upper part of the oven due to its lower density.

The venturi 20, as it is largely known in the previous art, has the role of reducing the pressure in this region, increasing the rate of fuel gas injected by means of the Venturi effect. Therefore, a sufficient amount of air is sucked inside the burner 10, 12 as gas passes through.

After the air enters the burner 10, 12 together with the fuel gas, an efficient mix of the two gases for ensuring an efficient combustion, and a pressure drop of the fluid downstream from the venturi 20 for reducing the rate, and preventing the undesirable effects of flame leaking must be assured.

Figure 6:
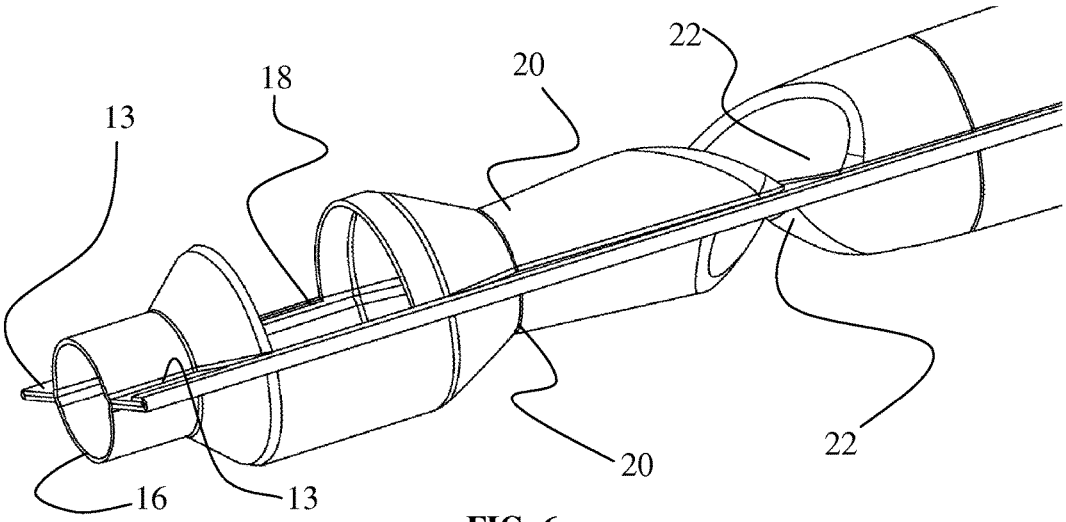
FIG. 6 illustrates a second perspective view of the front part from the burner of the present invention.

For this purpose, the burner 10, 12 comprises at least one flange 22 inside the burner located downstream a venturi 20, and inclined from an internal flow of fluid. Preferably, as it is illustrated in FIG. 6, two internal flanges 22, diametrically opposite from each other, are provided, being each one of them inclined in one direction. This forces the fluid to move in a helicoidal trajectory by passing through such flanges 22, generating a spiral flow, turbulent or not, that substantially increases the collision rate between molecules, and consequently, the homogeneity of the fuel gas/air mixture. Additionally, this obstacle promotes a pressure drop of the flow, preventing the undesirable effects on the flame mentioned above.

Figure 7:
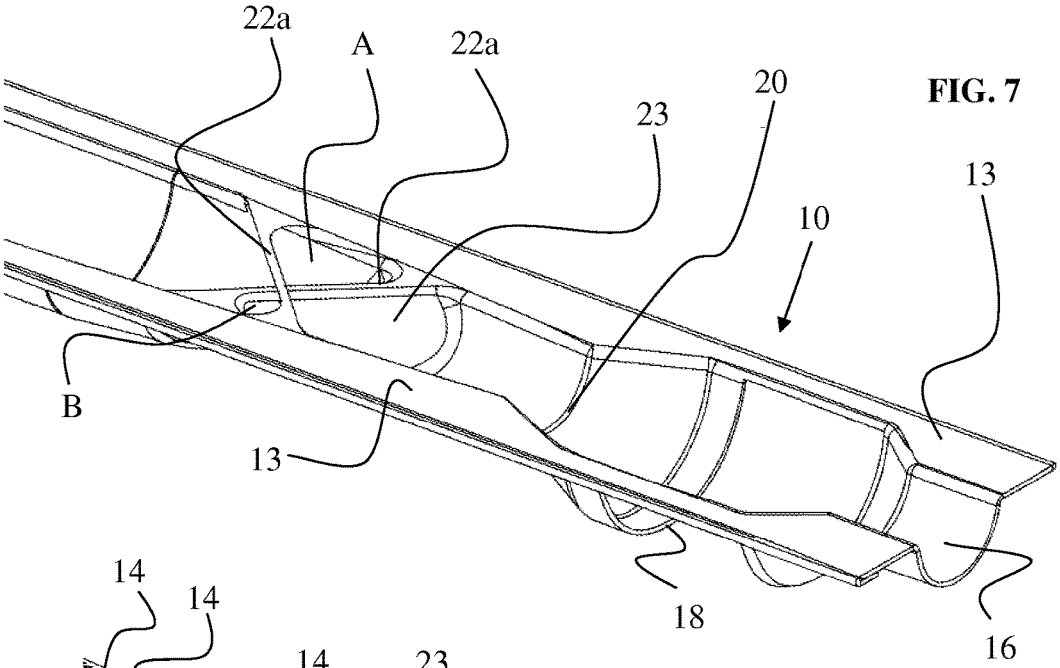
FIG. 7 illustrates a section of the central plane in the front part from the burner of the present invention.

Preferably, both flanges 22 are inclined in a symmetrical and opposite manner from the direction of the fluid flow. FIG. 7 illustrates a section of the central plane of the burner 10, wherein it is possible for a half of the burner, and only the most internal region 22*a* of the flange 22 from the other half of the burner, to be seen. It should be noted here that, preferably, the most internal regions 22*a* of the flanges 22 of the burner are coplanar to the central plane of the burner. Preferably, the flanges 22 are inclined in 45° from the direction of the flow, each one inclined to one direction. In this embodiment, the flanges' 22 diametrically opposite directions are inclined 90° from each other. Even in FIG. 7, the openings A, B inside the burner, formed by the flanges 22, through which the fluid flow passes through, can be seen.

Figure 8:
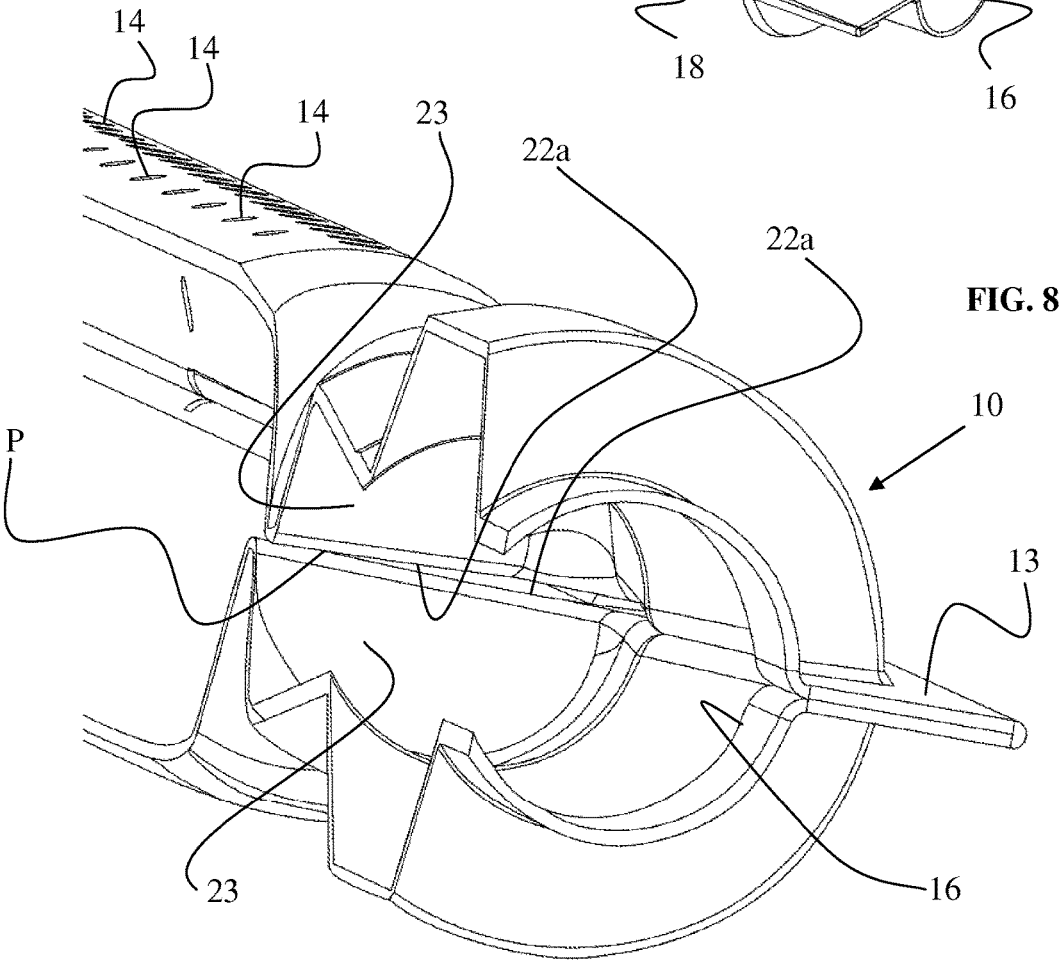
FIG. 8 illustrates a perspective view of the lateral section from the burner of the present invention.
Figure 9:
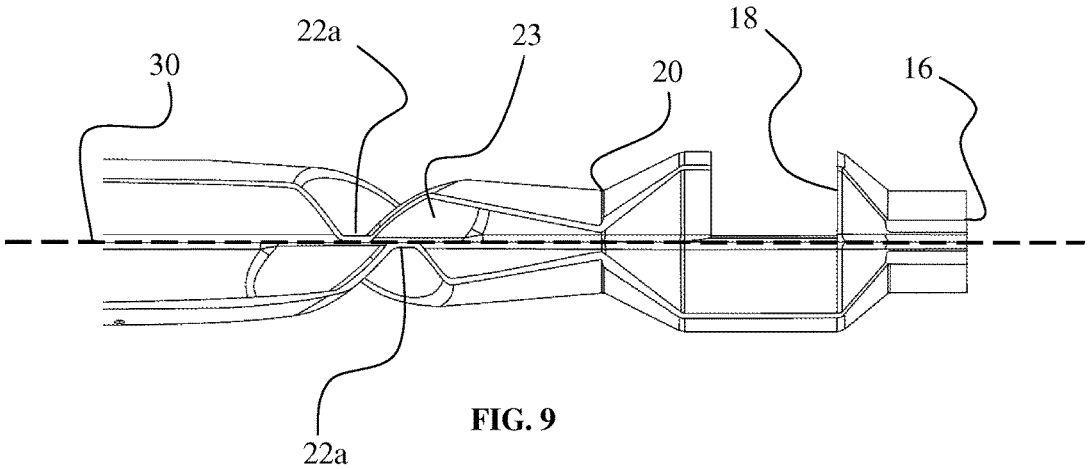
FIG. 9 illustrates a lateral view of the lateral section from the burner of the present invention.

Optionally, as it is illustrated in FIG. 8, the flanges 22 penetrate toward the center of the transversal section of the burner 10, 12, so their ends 22*a* are in contact (on point P.) Thus, two inclined walls 23 (each one in one direction) in the fluid's trajectory are provided, leaving no space for a linear trajectory to take place. Optionally, the most internal ends 22*a* of the flanges 22 are coplanar to the lateral portions 13 in the metal plate, as it is illustrated in FIG. 9, which is a lateral view of the illustrated section in the burner in FIG. 8.

Optionally, the flanges 22 are offset from each other to the longitudinal axis of the burner 10, 12, depending on the length of the desired pressure fall, and the length of the rotational movement desired to be applied to the fluid. The more offset the flanges 22 are from each other, the less the rotation and the pressure drop of the flow.

Still optionally, the lateral burners 10 can be rotated around their longitudinal axes in order to change the flame direction, and consequently the type of food cooking. Preferably, a pivot axle 24 (FIG. 1) is provided in the opposite end of the fuel gas inlet 16 of the lateral burners 10. Preferably, the lateral burners 10 are equipped with flaps 25, and the flaps 25 and pivot axle 24 are pressed jointly with the rest of the burner 10 from the same metal plate, making up for only one piece. This pivot axle 24 can be rotated by a traction movement from the flap of 25 that can be connected to a button or manipulating device in the exterior of the oven (not illustrated), allowing the user to adjust the inclination of the burners, and therefore, the flame. Alternatively, the pivot axle 24 or the flap 25 can be connected to a, preferably electric, motor (not shown) so the rotation takes place automatically according to the type of cooking selected by the user.

Additionally, the present invention provides a method for manufacturing a burner 10, 12 for a gas stove oven, comprising the stages of:

forming a metal plate in order to provide side-to-side halves for a casing 10*a*, 12*a* for the burner 10, 12;

folding the casing halves 10*a*, 12 for them to be facing each other, thus forming the burner 10, 12 itself, and fastening the free ends of the casing 10*a*, 12*a;* wherein at least one flange 22 inside the burner 10, 12 located downstream from a venturi 20, and inclined from an internal flow of fluid, is additionally provided in the stage of forming a metal plate.

Therefore, the present invention provides a gas stove oven burner, and a method for its manufacture, that promotes a total mix of fuel gas and air, thus allowing the use of both natural gas and liquefied gas. Additionally, an efficient air/fuel gas mixture with a pressure drop, with no need for an additional component inside the burner, is promoted as the flanges are directly pressed over the burner casing manufacture, the same process being used.

Several variations focused in the protection scope of the present application are allowed. Therefore, the fact that the present invention is not limited by the particular configurations/embodiments described above is reinforced.

The invention claimed is:

1. A gas stove oven burner comprising a casing manufactured by forming at least one metal plate, the casing comprising a venturi, at least one flange inside the burner located downstream with respect to a flow direction of an internal flow of fluid from the venturi, a pivot axle located at an opposite end of a fuel gas inlet of the burner, and jointly formed as a single piece of the metal plate of the casing, wherein the pivot axle is configured to adjust an inclination of the burner, and a flap formed of a same metal plate of the casing and folded as a single piece with the at least one metal plate of the casing, the flange terminating at an internal edge that is inclined relative to the flow direction and coplanar to lateral portions of the metal plate and a central plane of the burner.

2. A gas stove oven burner according to claim 1, wherein the at least one flange comprises two flanges, diametrically opposite from each other and each being inclined in one direction.

3. A gas stove oven burner according to claim 2, wherein the two flanges are inclined in a symmetrical and opposite manner relative to the flow direction.

4. A gas stove oven burner according to claim 2, wherein the two flanges extend toward a center of a transversal section of the burner, so that respective internal ends of the two flanges are in contact.

5. A gas stove oven burner according to claim 2, wherein the two flanges are offset from each other with respect to the flow direction along a longitudinal axis of the burner.

6. A method for manufacturing a gas stove oven burner, comprising:

forming a metal plate to provide side-to-side halves for a casing for the burner;

folding the halves to face each other, thus forming the burner itself; and fastening respective free ends of the halves, wherein the casing comprises at least one flange inside the casing located downstream from a venturi, and inclined from an internal flow of fluid, the flange terminating at an internal edge that is coplanar with a central plane of the burner, and wherein forming the metal plate to provide side-by-side halves and folding the halves to face each other comprise forming a flap.

7. A method for manufacturing a gas stove oven burner according to claim 6, wherein forming the metal plate to provide side-by-side halves and folding the halves to face each other comprise forming a pivot axle at the end of the burner.

8. The method for manufacturing a gas stove oven burner according to claim 6, wherein the flange is formed during the stage of forming the metal plate to provide side-by-side halves.

9. A method for manufacturing a gas stove oven burner, the method comprising:

forming a metal plate to provide side-to-side halves for a casing for the burner and lateral portions, wherein the lateral portions exceed a burner region of the burner and provide a central plane of the metal plate;

forming at least one flange inside the casing, wherein the flange is located downstream from a venturi and inclined from an internal flow of fluid through the casing, and wherein an internal edge of the flange is coupled to and coplanar to the lateral portions of the casing;

forming a pivot axle at an opposite end of a fuel gas inlet of the burner, wherein the pivot axle is jointly formed as a single piece of the metal plate of the casing, and configured to adjust an inclination of the burner;

folding the halves to face each other, thus forming the burner itself; and fastening respective free ends of the halves.

* * * * *